US005771425A

United States Patent [19]

Yamada et al.

[11] Patent Number: 5,771,425

[45] Date of Patent: Jun. 23, 1998

[54] MECHANICALLY FASTENED CYLINDRICAL ENGAGING MEMBER FOR USE IN AN IMAGE FORMING APPARATUS

[75] Inventors: Yusuke Yamada, Machida; Toshiyuki Yoshihara, Inagi; Tadayuki Tsuda; Isao Ikemoto, both of Kawasaki; Mitsuru Miyamoto, Yokohama, all of Japan

[73] Assignee: Canon Kabushiki Kaisha, Tokyo, Japan

[21] Appl. No.: 276,484

[22] Filed: Jul. 18, 1994

Related U.S. Application Data

[63] Continuation of Ser. No. 920,923, Jul. 28, 1992, abandoned.

[30] Foreign Application Priority Data

Aug. 2, 1991 [JP] Japan ..... 3-194117

[51] Int. Cl.[6] ..... G03G 15/06; G03G 21/00

[52] U.S. Cl. ..... 399/111; 399/116; 399/119

[58] Field of Search ..... 355/200, 211, 355/212; 492/22, 47; 29/895.22, 511, 513; 399/107, 110, 116, 117, 119

[56] References Cited

U.S. PATENT DOCUMENTS

| | | | |
|---|---|---|---|
| 1,092,464 | 4/1914 | Watson et al. | 482/47 X |
| 2,429,293 | 10/1947 | Peck et al. | 29/895.22 |
| 4,003,334 | 1/1977 | Samuels et al. | 118/658 |
| 4,344,218 | 8/1982 | Hooper et al. | 29/895.22 X |
| 4,373,468 | 2/1983 | Suda et al. | 355/260 X |
| 4,386,839 | 6/1983 | Kumagai et al. | 355/200 |
| 4,540,268 | 9/1985 | Toyono et al. | 355/3 R |
| 4,575,221 | 3/1986 | Onoda et al. | 355/200 |
| 5,052,090 | 10/1991 | Kitaura et al. | 355/211 X |

FOREIGN PATENT DOCUMENTS

| | | |
|---|---|---|
| 86-210535 | 9/1987 | China . |
| 0036631 | 9/1981 | European Pat. Off. . |
| 0419122 | 3/1991 | European Pat. Off. . |
| 2630364 | 10/1989 | France . |
| 55-077746 | 6/1980 | Japan . |
| 58-086553 | 5/1983 | Japan . |
| 62-287258 | 12/1987 | Japan . |

*Primary Examiner*—Fred L. Braun

*Attorney, Agent, or Firm*—Fitzpatrick, Cella, Harper & Scinto

[57] ABSTRACT

A cylindrical structure is formed by a cylinder and a terminal engaging member, such as a gear or flange for rotating the cylinder. The terminal engaging member has a head which is inserted into the cylinder and a plurality of recesses by which the member is fastened to at least one end of the cylinder through bending and cutting the assocrated cylinder at plural parts thereof into the recesses of the terminal engaging member. In this mannaer, the joint between the cylinder and the terminal engaging member can be formed securely in a simple manner. The cylindrical structure may be employed, for example, as a photosensitive drum or a developing sleeve for electrophotography.

57 Claims, 4 Drawing Sheets

MECHANICALLY FASTENED CYLINDRICAL ENGAGING MEMBER FOR USE IN AN IMAGE FORMING APPARATUS

This application is a continuation of application Ser. No. 07/920,923 filed Jul. 28, 1992, now abandoned.

FIELD OF THE INVENTION AND RELATED ART

The present invention relates to a cylindrical structure or cylindrical member used in apparatus or instruments for office use, such as copying machines, printers and facsimile apparatus.

Hitherto, a cylindrical electrophotographic photosensitive member (hereinafter sometimes called a "photosensitive drum") has been formed by providing both ends of a cylinder, having a peripheral surface coated with a photoconductive substance, with a terminal engaging member, such as a drum flange or drum gear for rotating the photosensitive drum (hereinafter simply called a "flange" or "gear") which is engaged with the ends of the cylinder by bonding with an adhesive or by force fitting under an external pressure.

The engagement by bonding has been effected by applying an appropriate amount of adhesive onto a part of the gear or flange to be inserted into the cylinder and, after the fitting, causing the adhesive to be completely cured while keeping the fitted members in a place (environment) not affected by a change in temperature or humidity. For the adhesive, an instant adhesive, and an adhesive primer together with an anaerobic adhesive, etc., have been generally used selectively in view of the usage, purpose, required strength, etc.

However, several difficulties as mentioned below have been encountered with respect to conventional photosensitive drums prepared as described above.

(1) In the case where the bonding and curing are effected in a high temperature—high humidity environment (e.g., temperature: 32.5° C., relative humidity: 85%), moisture in the atmosphere adversely affects the bonding surface and results in a low torque strength.

(2) A very long time is required until the complete curing of an adhesive, depending on the kind of the adhesive used, so that a large space is required for storage during the curing time and a facility for maintaining the temperature and humidity of the storage area is also required. Thus, several inconveniences are encountered also with respect to cost, management and productivity.

(3) In order to obtain a high bonding strength, materials for use in the gear and flanges are restricted.

(4) In the case where an electrical contact with an apparatus body is ensured by providing the gear or flange end with an electrode plate contacting the inner surface of the cylinder, flagging or flowing of the adhesive can occur before the complete curing to cause a conduction failure between the electrode plate and the inner surface of the cylinder.

(5) In the case of force fitting, a sufficient strength of engagement has not heretofore been obtained between the gear or flange and the cylinder.

SUMMARY OF THE INVENTION

An object of the present invention is to provide a cylindrical member or structure comprising a cylinder (or cylindrical substrate) and a terminal engaging member, such as a gear or flange, secured to an end of the cylinder with a sufficient securing or engaging force.

Another object of the present invention is to provide a cylindrical structure including a cylinder and a terminal engaging member which is easily engageable with an end of the cylinder.

Still another object of the invention is to provide a cylindrical structure including a cylinder and a terminal engaging member provided with an electrode plate which can be easily placed in reliable electrical contact with an end of the cylinder.

A further object of the present invention is to provide an apparatus equipped with a cylindrical structure as described above.

According to the present invention, there is provided a cylindrical structure, comprising: a cylinder and a terminal engaging member fastened to at least one end of the cylinder, the terminal engaging member having a head inserted into the cylinder and a recess adjacent to the head, wherein the terminal engaging member is fastened to said at least one end of the cylinder by bending and cutting an end brim of the associated cylinder end into the recess of the terminal engaging member.

In the cylindrical structure according to the present invention, the cylinder and the terminal engaging member are fastened to each other with a strong engaging force. The strong engaging force is provided by bending and cutting the end brim of the cylinder into the recess of the terminal engaging member adjacent to the head which is inserted into the cylinder. This is because, by bending and cutting, instead of simple bending of the end brim of the cylinder, the bent and cut end brim is caused to intimately enter the recess of the terminal engaging member. The bending and cutting of the cylinder end brim can be easily performed by using a wedge-or claw-shaped thrusting member. As a result, the cylinder end brim is fastened in intimate contact with the recess. This engagement is not affected by external influence even under various environmental conditions (ranging from low temperature—low humidity to high temperature—high humidity) and therefore is able to keep a stable fastening force, thus providing a torque strength identical to or even higher than those obtained by conventional bonding or force fitting.

The engagement or fastening between the terminal engaging member and the cylinder can be effected by a simple method of pressing a thrusting or protruding member from an outer periphery of the cylinder. Accordingly, a complete curing time as required in the conventional bonding method is not required but the engagement can be performed instantaneously, thus being advantageous with respect to productivity and production cost.

Further, as no adhesive is required, it is not required to exercise the control of the property of the adhesive or employ the drying step and storage space after the bonding. Further, the engagement torque strength is not affected by the material of the terminal engaging member, so that the material thereof can be freely selected in view of its purpose and usage.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
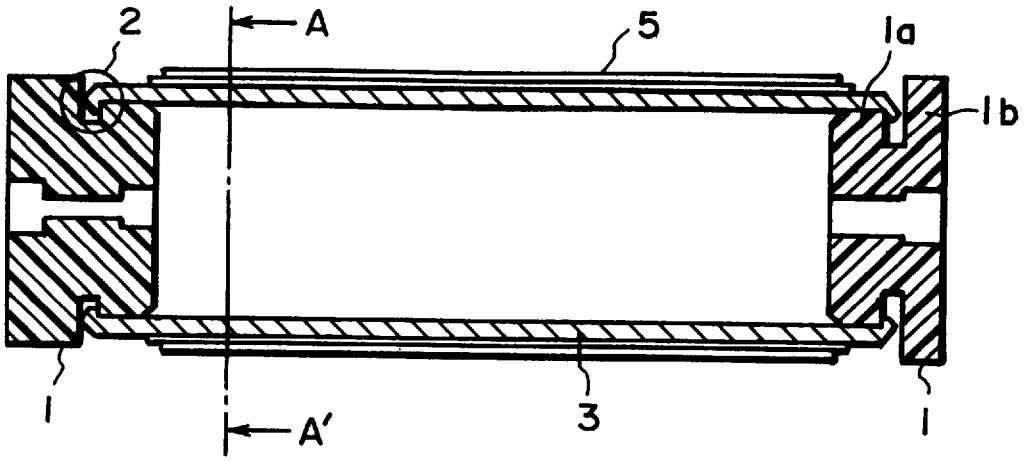
FIG. 1 is a sectional view of a photosensitive drum according to the present invention.

The cylinder may preferably have an end brim section having a thickness of 0.3 –1.5 mm, particularly 0.5–1.5 mm. The cut length of the end brim during the bending and cutting step may preferably be at least 0.2 mm, particularly at least 0.25 mm. This point will be explained in further detail hereinafter.

The cylindrical structure according to the present invention may effectively be used as various image bearing members are (e.g. a photosensitive drum) and also may be used as various roller members (e.g.) a platen roller, a conveying roller, a developing sleeve, a fixing roller or a printing plate roller. That is, the present invention relates to cylindrical members to which a driving force is transmitted and which therefore require a strong engagement between a cylinder and a terminal engaging member constituting the same.

The photosensitive drum, i.e., a photosensitive member in a cylindrical form, for electrophotography may take various forms so as to attain desired characteristics or depending on the kinds of electrophotographic processes applied thereto. Representative photosensitive members for electrophotography may include a photosensitive drum comprising a photoconductive layer formed on a cylindrical support and a photosensitive drum further including a surface protective layer thereon, which have been widely used. The photosensitive drum comprising a cylindrical support and a photoconductive layer may be used for image formation by the most popular electrophotographic process including charging, imagewise exposure, development and further transfer as desired. As for the photosensitive drum provided with a protective layer, such a protective layer may be provided for the purpose of, e.g., protecting the photoconductive layer, improving the mechanical strength of the photosensitive member, improving the dark decay characteristic, or providing a characteristic suited for a certain electrophotographic process.

Some other representative image forming processes, in which cylindrical image-bearing members may be used, are described below.

(1) In order to improve the repetitive usability of an electrophotographic photosensitive member, an electrostatic image formed on the electrophotographic photosensitive member is transferred to another image-bearing member for development, and the resultant toner image is transferred to a recording member. (2) In another electrophotographic process involving forming an electrostatic image on another image-bearing member corresponding to an electrostatic image formed on an electrophotographic photosensitive member, an electrostatic image is formed on an electrophotographic photosensitive member in the form of a screen having a large number of minute openings through a prescribed electrophotographic process. A corona charging treatment is applied to another image-bearing member by the medium of the electrostatic image to modulate the corona ion stream, thereby forming an electrostatic image on the above-mentioned other image-bearing member, and the electrostatic image is developed with a toner and transferred to a recording member to form a final image. (3) According to another electrophotographic process, a toner image formed on an electrophotographic photosensitive member or another image-bearing member is not directly transferred to a recording member but is once transferred to still another image-bearing member, and the toner image is then transferred to a recording member to be fixed thereon. This process is particularly effective for production of color images and high-speed copying. The recording member may ordinarily be a flexible material, such as paper or film. Accordingly, rather than transferring three color images to a recording member with precise positional alignment, a more accurately aligned color image can be formed if three color images are transferred onto an image-bearing member composed of a material substantially free from deformation and then transferred to a recording member at a time. Further, the transfer of a toner image to a recording member by the medium of an image-bearing member is also effective for high-speed copying. (4) In another process, an electric signal is applied to a multi-stylus electrode to form an electrostatic image on an image-bearing member corresponding to the electric signal, and the electrostatic image is developed to provide an image.

The image-bearing members used in electrostatic image-forming process like those of (1)–(4) above do not require a photoconductive layer.

Thus, cylindrical image-bearing members on which electrostatic images or toner images are formed may comprise various members which may generally have an insulating layer as the surface layer, as (e.g. an electrophotographic photosensitive member having a surface layer which may be a protective layer) or a photoconductive layer.

The cylindrical structure according to the present invention may for example be prepared in the following manner. A head (i.e., a part to be inserted into a cylinder) of a terminal engaging member is inserted into a cylinder of, e.g., aluminum, copper or stainless steel. Adjacent the head is disposed a recess extending toward the inside or axis of the terminal engaging member. The recess may have an appropriate shape (inclusive of width, length and depth). To an end brim part covering the recess of the cylinder, a generally claw-or wedge-shaped thrusting member having a tip forming an acute angle and having a width almost identical to the recess is abutted and pushed toward the inside of the recess to achieve a certain amount of penetration, whereby the cylinder end brim is bent and sheared almost simultaneously into a shape conforming with the recess. The sheared part of the bent and cut end brim is intimately attached to and fitted with the recess contour, and the bent and cut part (particularly the inner surface thereof) of the end brim is intimately attached to the side and bottom of the recess, whereby a reliable fastening is secured.

Figure 2:
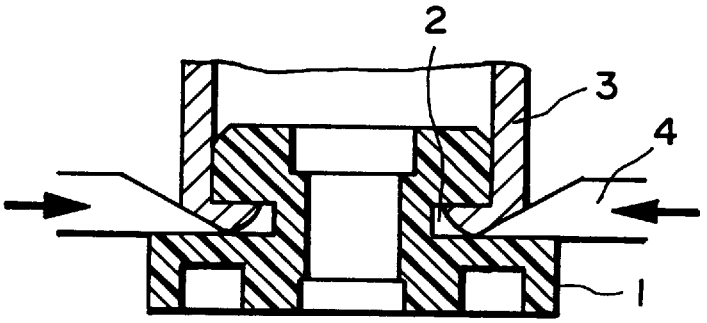
FIG. 2 is a sectional illustration of a bending and cutting step.
Figure 3:
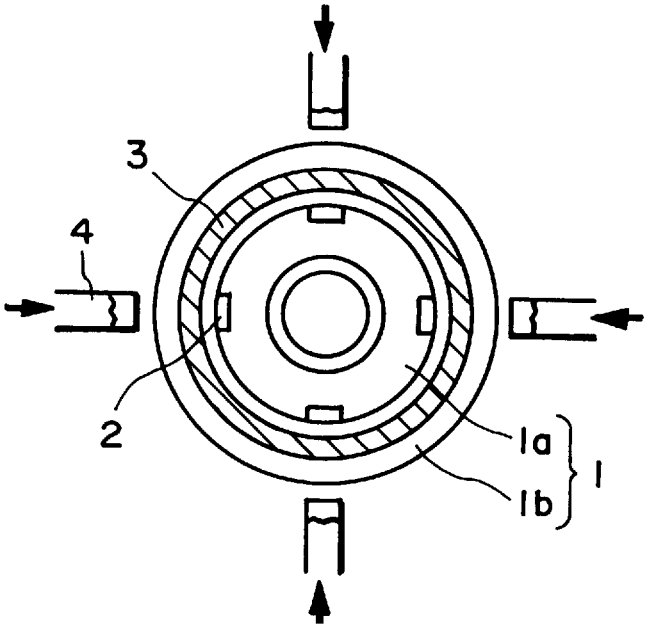
FIG. 3 is a corresponding top plan view.
Figure 4A:
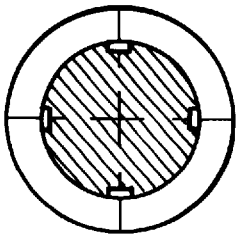
FIG. 4A–4D are sectional views each showing a circular section example of a terminal engaging member engaged with a photosensitive drum according to the present invention.
Figure 4B:
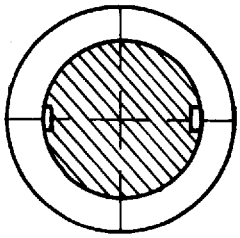
Figure 4C:
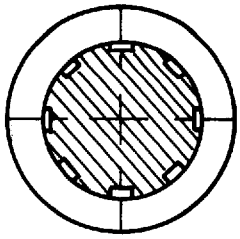
Figure 4D:
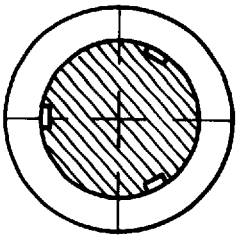

Hereinbelow, the present invention will be explained, based on an embodiment wherein the cylindrical structure is a photosensitive drum, with reference to drawings. FIG. 1 is a sectional view of a photosensitive drum according to the present invention. Referring to FIG. 1, the photosensitive drum includes a gear or flange 1 as a terminal engaging member engaged with the ends of the photosensitive drum for rotatably supporting the photosensitive drum and provided with recesses 2, and a cylinder (cylindrical substrate) 3 of aluminum alloy surface-coated with a photoconductive layer 5 of a photoconductive substance. The cylinder 3 is fitted about the gear or flange 1 with a certain fitting allowance and engaged with the gear or flange 1 at the recesses 2. The gear or flange 1 may be regarded as comprising a head (part to be inserted into the cylinder) l*a*, a base l*b* with or without teeth at its periphery (depending on whether it is a gear or flange) and recesses 2 formed between the head 1*a* and the base l*b*. FIGS. 2 and 3 are a sectional view and a corresponding top plan view, respectively, for illustrating the bending and cutting of a cylinder end brim. For this purpose, a thrusting member 4 is abutted to and pushed against an end brim of the drum cylinder 3 after the gear or flange 1 is fitted into the cylinder 3 so as to thrust the end brim into the recess 2 of the gear or flange 1 while bending and shearing the brim.

The cylinder 3 is fitted about the outer periphery of the head 1*a* of the gear or flange 1. The fitting at this stage should preferably be not too loose as to allow relative movement between both members but free from deformation of the outer surface of the cylinder 3 brim. More specifically, a clearance of 0–10 $\mu$m is preferred between the gear or flange and the cylinder 3. Then, after the gear or flange 1 and the cylinder 3 are fitted with each other, a claw-or wedge-shaped thrusting member 4 having a tip with an acute angle is abutted against the outer periphery of the cylinder 3 at four parts around the head 1*a* of the gear or flange 1 as shown in FIG. 3. At this time, as shown in FIG. 2, each of the four thrusting members 4 are disposed at the same height as the lower end of the cylinder 3. The tips of the thrusting members have a width identical to the width of the recess 2 and are each disposed in horizontal alignment with an associated one of the recesses 2 of the gear or flange 1 fitted into the cylinder 3, as shown in FIG. 3. Each thrust member is then linearly moved along its axis for abutting. Then, after the abutting, each thrusting member 4 is moved forward with a certain penetration toward the axis of the gear or flange 1, whereby the end brim is bent from its very lower end along the surface shape of the thrusting member 4 and, on further penetration, the end brim is sheared at parts corresponding to the widths of the recesses 2. As a result, cut and bent parts of the end brim are intimately attached and fixed in the recesses 2, so that the gear or flange 1 and the cylinder 3 are securely fastened to each other.

More specifically, at this time, the end brim is completely sheared and the sheared surface thereof is intimately attached to the contour of the recesses 2. Thus, the bent and cut part of the end brim is intimately fastened to the recess 2 so that a high engaging force is exhibited without allowing relative movement or loosening between the cylinder 3 and the gear or flange 1 in the directions of the rotation and axis of the photosensitive drum. Recesses 2 may be formed at an arbitrary plural number of locations (e.g. 2, 3, 4, 8 or even more locations); preferably point-symmetrically with respect to the axis of the gear or flange 1 as shown in FIG. 4 for example.

The end peripheral section of the cylinder 3 subjected to the bending and cutting may desirably be exposed, i.e., free of coating of a photosensitive substance, for a length of at least 1.0 mm, preferably at least 5.0 mm, from the very end in the longitudinal direction of the cylinder 3. The coating-free end section length should not be excessively large since it can decrease the image forming area formed by the coated area.

Figure 5:
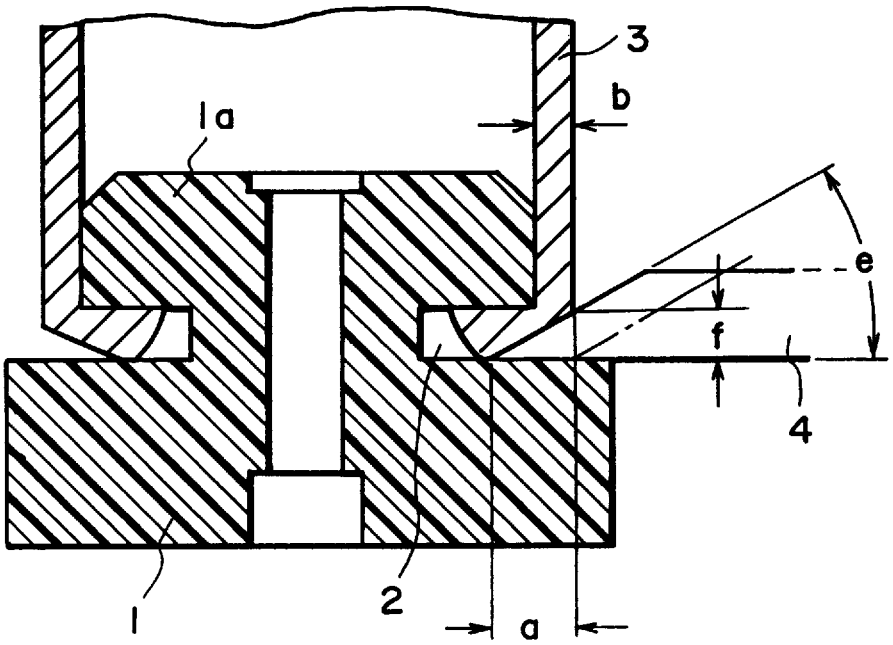
FIG. 5 is a sectional view for illustrating sizes involved in the bending and cutting step.

The sizes involved in the bending and cutting step will now be described with reference to FIG. 5. Referring to FIG. 5, the thrusting member 4 is allowed to enter for a penetration a toward inside the cylinder from the position where it just contacts the outer periphery of the cylinder 3. By adjusting the penetration a, it is possible to control the fastening force between the gear or flange 1 and the cylinder 3. The cylinder 3 has a thickness b and may ordinarily comprise a drawn pipe of an aluminum-based metal. In specific examples described hereinafter, an aluminum-based drawn pipe ("H63S"(trade name) available from Kobe Seiko K.K.) having a thickness b of 0.7 mm (outer diameter: 29.92 mm, inner diameter: 28.50 mm) and a length of 260.5 mm was used. A larger thickness b provides a larger fastening torque strength, but too large a thickness b requires a very large force for bending and cutting by the thrusting member 4, thus adversely affecting the size accuracy of the surrounding parts. For this reason, a thickness b of 0.3–1.5 mm, particularly 0.6–1.0 mm, is preferred for sizes of a cylinder as described above. The thrusting member 4 may have a tip angle e which may be arbitrarily set in consideration of its shape, etc., but basically an acute angle, preferably in the range of 10–70 degrees, more preferably 20–40 degrees. Incidentally, in the examples appearing hereinafter, a claw- or wedge-shaped thrusting member having smooth surfaces, a tip angle of 30 degrees and a width of 3 mm was used.

The end brim of the cylinder 3 is cut in a length of f. A larger cut length f provides a larger fastening force. The cut length f may depend on the penetration a and may preferably be at least 0.2 mm, or, even more preferably at least 0.4 mm. However, the length f need not exceed 3 mm.

Figure 6:
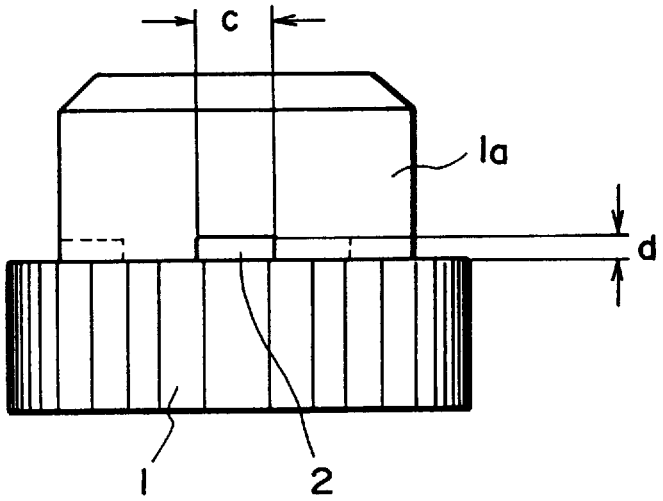
FIG. 6 is a sectional view for illustrating the sizes of a recess of the terminal engaging member (gear or flange).

FIG. 6 illustrates sizes of the recess 2 formed in the gear or flange 1. More specifically, the recess 2 has a width (peripheral length in a direction transverse to the axis of the gear of flange 1) c, and a height (length in the direction of the axis of the gear or flange 1) d. These sizes of the recess 2 may be set to appropriate values depending on the outer diameter and the thickness of the drum cylinder 3. For the above-described sizes of the cylinder, for example, the width c may desirably be at least 1 mm, and the height d may desirably be at least 0.5 mm. The shape of the recess 2 is not limited to a rectangular one but may be circular, arc-shaped (partial circle), triangular, etc. The shape and size of the recess can be changed depending on the shape and outer diameter of the gear or flange 1, and the tip shape of the thrusting member 4 can be changed accordingly.

The cut and bent part of the cylinder end brim may preferably have a width which is in the range of 0.95–1 times the width of the recess 2, particularly identical to the width of the recess 2.

Figure 7:
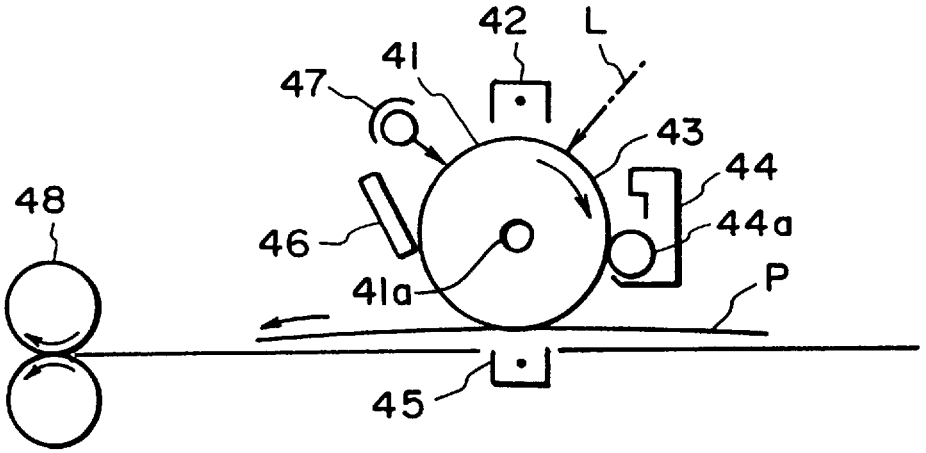
FIG. 7 is an illustration of an arrangement of an ordinary transfer-type electrophotographic apparatus using a photosensitive drum according to the present invention.

FIG. 7 shows an outline of an ordinary transfer-type electrophotographic apparatus including a photosensitive drum according to the present invention.

Referring to FIG. 7, the apparatus includes a photosensitive drum 41 as an image-bearing member which rotates about an axis 41*a* at a prescribed peripheral speed in the direction of the arrow. In the course of the rotation, the peripheral surface of the photosensitive drum 41 is uniformly charged to a positive or negative prescribed potential by a charging means 42 and then exposed to image light L by an imagewise exposure means (not shown, such as slit exposure means or laser beam scanning exposure means) at an exposure position 43. As a result, an electrostatic latent image corresponding to the exposure light image is sequentially formed on the peripheral surface of the photosensitive drum 41.

The electrostatic latent image is then developed with a toner by a developing means 44 including a developing sleeve 44*a*, and the resultant toner image is sequentially transferred by a transfer means 45 onto a transfer material or paper P which has been supplied between the photosensitive member 41 and the transfer means 45 in synchronism with the rotation of the photosensitive member 41 by a paper-supplying unit (not shown). Herein, it is also possible to form the developing sleeve 44*a* as a cylindrical structure according to the present invention.

The transfer material P having received the toner image is separated from the photosensitive member surface and introduced to an image fixing means 48 for image fixation to be discharged as a copy product out of the apparatus.

After image transfer, the surface of the photosensitive member 41 after the image transfer is subjected to removal of transfer-residual toner by a cleaning means 46 to be cleaned and used for repetitive image formation.

A corona charging device is widely used in general as the uniform charging means 42 for the photosensitive member 41. A corona transfer means is also widely used in general as the transfer means 45.

In the electrophotographic apparatus, plural members including some of the above-mentioned photosensitive member 41, developing means 44, cleaning means 46, etc., can be integrally combined to form an apparatus unit so that the unit can be readily connected to or released from the apparatus body. For example, the photosensitive member 41 and the cleaning means 46 can be integrated into a single unit so that it can be attached to or released from the apparatus body by a guide means such as a guide rail provided to the apparatus body. In this instance, the apparatus unit can also be integrally accompanied with the charging means 42 and/or the developing means 44.

In a case where the electrophotographic apparatus is used as a copying machine or a printer, the image light L is a reflected light or transmitted light from an original, or an image light formed by coding read data from an original and scanning a laser beam or driving a light-emitting diode array or a liquid crystal shutter array based on the coded data.

Figure 8:
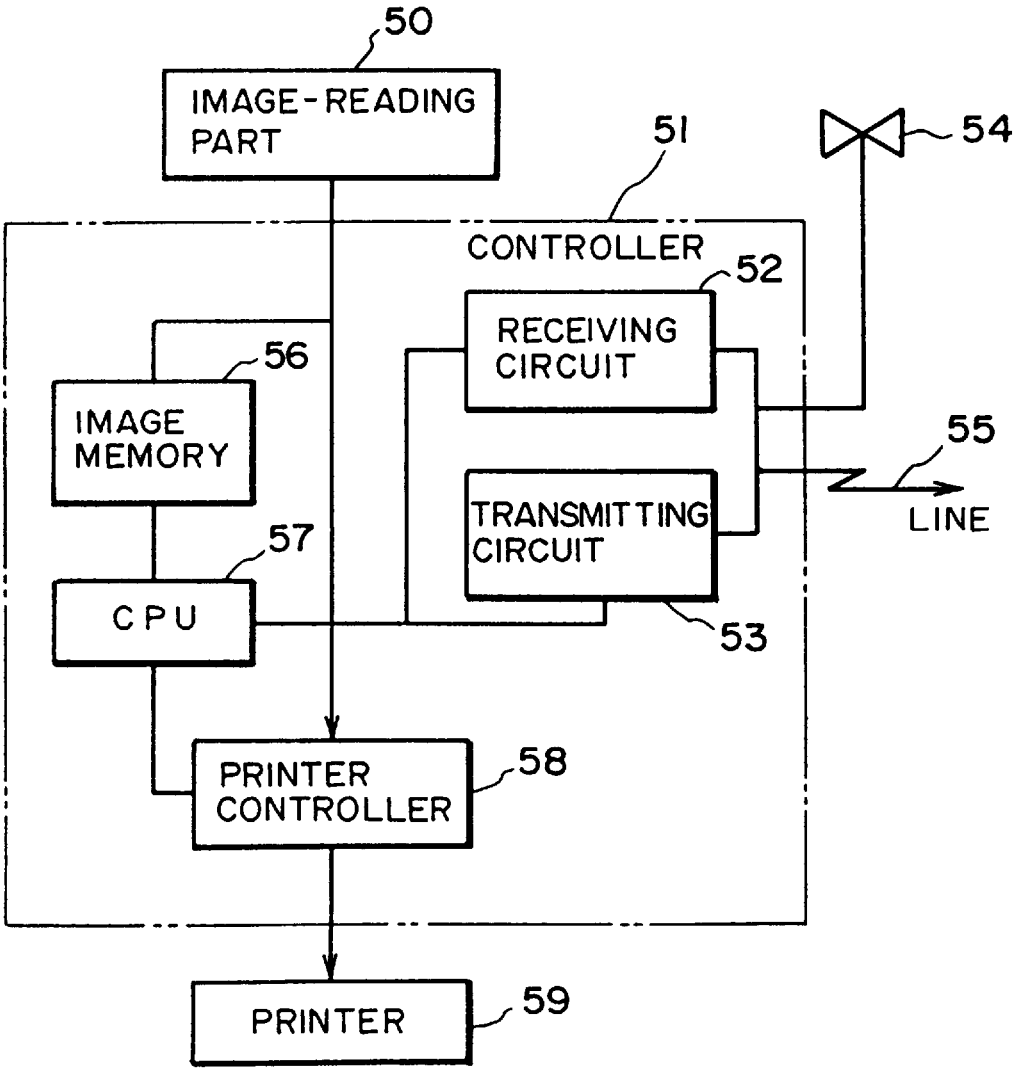
FIG. 8 is a block diagram of a facsimile apparatus including an electrophotographic apparatus equipped with a photosensitive drum according to the present invention as a printer.

In a case where the image forming apparatus is used as a printer for a facsimile machine, the image light L may be replaced by exposure light image for printing received data. FIG. 8 is a block diagram for illustrating such an embodiment.

Referring to FIG. 8, a controller 51 controls an image reader (or image reading unit) 50 and a printer 59. The entirety of the controller 51 is regulated by a CPU 57. Data read from the image reader 50 is transmitted through a transmitter circuit 53 to a remote terminal such as another facsimile machine. On the other hand, data received from a remote terminal is transmitted through a receiver circuit 52 to a printer 59. An image memory 56 stores prescribed image data. A printer controller 58 controls the printer 59. A telephone handset 54 is connected to the receiver circuit 52 and the transmitter circuit 53.

More specifically, an image received from a line (or circuit) 55 (i.e., image data received from a remote terminal connected by the line) is demodulated by means of the receiver circuit 52, decoded by the CPU 57, and sequentially stored in the image memory 56. When image data corresponding to at least one page is stored in the image memory 56, image recording or output is effected with respect to the corresponding page. The CPU 57 reads image data corresponding to one page from the image memory 56, and transmits the decoded data corresponding to one page to the printer controller 58. When the printer controller 58 receives the image data corresponding to one page from the CPU 57, the printer controller 58 controls the printer 59 so that image data recording corresponding to that page is effected. During the recording by the printer 59, the CPU 57 receives image data corresponding to the next page.

Thus, receiving and recording of an image may be effected in the above-described manner by using an electrophotographic apparatus equipped with an image-bearing member according to the present invention as a printer.

EXAMPLE 1

A photosensitive drum as shown in FIG. 1 was prepared through a process as explained with reference to FIGS. 1–6 above.

An aluminum-made drawn cylinder or tube ("H63S" (trade name) available from Kobe Seiko K.K.; inner diameter 28.50 mm and thickness of 0.7 mm respectively at the fitting ends; length: 260.5 mm) was coated by dipping with an ammoniacal aqueous solution of casein (casein 11.2 g, 28%-ammonia water 1 g, water 222 ml), followed by drying to form a primer layer at a rate of 1.0 g/m$^2$.

Then, 1 wt. part of aluminum chloride phthalocyanine, 1 wt. part of butyral resin ("Eslec BM-2"(trade name), available from Sekisui Kagaku K.K.) and 30 wt. parts of isopropyl alcohol were dispersed for 4 hours in a ball mill. The resultant dispersion was applied by dipping onto the above-prepared primer layer and dried to form a 0.3 $\mu$m-thick charge generation layer.

Separately, 1 wt. part of a hydrazone compound, 1 wt. part of polysulfone resin ("P1700"(trade name) available from Union Carbide Co.) and 6 wt. parts of monochlorobenzene were mixed by stirring. The resultant liquid was applied onto the charge generation layer by dipping and dried to form a 12 $\mu$m-thick charge transport layer, thus providing a coated drum cylinder 3 as shown in FIG. 1 in a state before bending.

Separately, a drum gear 1 having a section as shown in FIG. 1 was formed from polyacetal copolymer resin ("Duracon M90-02" (trade name) available from Polyplastic K.K.) by injection molding (under the conditions of nozzle temp.: 200° C., cylinder temp.: tip: 180° C., medium: 170° C., rear: 160° C.; mold temp.: cavity: 60° C., core: 60° C.) to have a head (inserted part) outer diameter of 28.49 mm and four rectangular recesses (width: 3 mm, height: 1.5 mm, depth: 3 mm) at 4 parts adjacent to the head and disposed at right angles from the axis of the gear 1.

To the gear 1 thus obtained, the above-prepared drum cylinder 3 was fitted so as to cover the head 1*a* of the gear 1 with its lower end brim, and four thrusting members 4 were caused to contact the outer surface of the lower end brim of the cylinder 3 as shown in FIG. 3. Each thrusting member 4 had a tip having a width of 3 mm and an angle (e) of 30 degrees and formed of SKD 30. After contact, the thrusting members 4 were further pushed against the cylinder end brim to a penetration of 2.5 mm to bend and shear the end brim so as to conform to the shape of the recesses 2. The cut length of the cylinder end brim was 1.4 mm. Thus, the gear 1 was fastened to one end of the drum cylinder. Another gear was similarly fastened to the other end of the drum cylinder.

The thus obtained photosensitive drum was loaded in a process cartridge for a laser beam printer ("LBP-SX"(trade name) available from Canon K.K.) and the process cartridge was left standing for 48 hours in an environment of high temperature-high humidity (32.5° C. –85 %RH). Then, the process cartridge was loaded in the laser beam printer and subjected to an image forming test of 10000 sheets. During the test, good images were obtained without occurrence of irregularities, such as pitch irregularities or fog, which might be attributable to the photosensitive drum. After the image forming test, the photosensitive drum was taken out of the cartridge to examine whether any defects, such as play, loosening and dislocation, occurred at the joint between the gear and the cylinder, no defects in these respects were observed at all. The photosensitive drum after the image forming test was fixed and subjected to measurement of a rupture torque at the joint by means of a commercially available torque gauge, whereby the rupture was caused at a torque of 160 kg-cm.

EXAMPLE 2

A photosensitive drum was prepared in the same manner as in Example 1 except that the thrusting member, after contact, was further pushed to cause a penetration of 2.0 mm. The cut length at the sheared part of the cylinder end brim was 1.10 mm. The resultant photosensitive drum was evaluated in the same manner as in Example 1, whereby similar results were obtained. The rupture torque of the photosensitive drum at the joint after the image forming test was 145 kg-cm.

EXAMPLE 3

A photosensitive drum was prepared in the same manner as in Example 1 except that the penetration of the thrusting member after contact was changed to 1.5 mm. The cut length at the sheared part of the cylinder end brim was 0.85 mm. The resultant photosensitive drum was evaluated in the same manner as in Example 1, whereby similar results were obtained. The rupture torque of the photosensitive drum at the joint after the image forming test was 122 kg-cm.

EXAMPLE 4

A photosensitive drum was prepared in the same manner as in Example 1 except that the penetration of the thrusting member after the contact was changed to 1.0 mm. The cut length at the sheared part of the cylinder end brim was 0.55 mm. The resultant photosensitive drum was evaluated in the same manner as in Example 1, whereby similar results were obtained. The rupture torque of the photosensitive drum at the joint after the image forming test was 70 kg-cm.

Comparative Example 1

A drum gear and a drum cylinder prepared in the same manner as in Example 1 were bonded to each other with 0.08 g of an instant adhesive ("ARONALPHA 432FTW" (trade name) available from Toa Gosei Kagaku Kogyo K.K. and left standing for 48 hours in an environment of 32.5° C. and 85%RH for complete curing. The resultant photosensitive drum was evaluated in the same manner as in Example 1, whereby the gear was dislocated after about 500 sheets of image formation. The bonding failure was determined to have been caused by an interfacial breakage at the boundary between the drum gear and the adhesive. The rupture torque at this time was 55 kg-cm.

Comparative Example 2

A drum cylinder and a drum gear prepared in the same manner as in Example 1 were fastened with each other in a similar manner as in Example 1 except that the thrusting member after contacting the periphery of the cylinder was further pushed to cause a penetration of only 0.5 mm whereby the gear was engaged with the cylinder only by staking, i.e. without causing cutting, of the cylinder.

The thus prepared cylinder was evaluated in the same manner as in Example 1 whereby a play of about 0.5 mm occurred in the rotational direction at the time of 6000 sheets during the durability test. After the durability test, the joint between the photosensitive drum and the drum gear was observed, whereby it was noted that the staked part of the cylinder was not sheared but a gap was found with the recess. The rupture disk at this time was 62 kg-cm.

EXAMPLE 5

The surface of an Al pipe (outer dia.=16 mm, thickness=0.8 mm, length=248 mm) was roughened by sand-blasting to a surface roughness (Ra) of 2.5 $\mu$m.

Then, the Al pipe surface was spray-coated with a paint of the following composition:

| | |
|---|---|
| Phenolic resin ("PLI-O-PHEN J-325, mfd. by Dai Nippon Ink K.K.) | 20 wt. parts |
| Carbon black (average diameter = 7 $\mu$m) | 9 wt. parts |
| Isopropyl alcohol | 20 wt. parts |

The resultant coating layer showed a surface roughness (Ra) of 3.0 $\mu$m.

To both ends of the developing sleeve thus formed, a flange having a head outer diameter of 14.38 mm made by injection molding of a polyacetal resin ("Duracon AW-01", made by Polyplastic K.K.) was fitted at a fit length of 3 mm. The flange was provided with four rectangular recesses (width=3 mm, height=1 mm, and depth=3 mm) at 4 parts adjacent to the head and disposed at right angles from the axis of the flange.

Then, to the end brim of the developing sleeve fitted about the head and recess of the flange, four thrusting members were abutted at the positions of the recesses and further pushed at a penetration of 1.5 mm against the end brim to bend and cut the brim at a cut length of 0.85 mm, whereby the flanges were fastened to the developing sleeve. Each thrusting member had a tip width of 3 mm and a tip angle of 30 degrees and was made of SKD 30.

The thus-prepared developing sleeve was loaded in a cartridge for a laser beam printer ("LBP-SX", mfd. by Canon K.K.) and left standing for 48 hours in an environment of high temperature-high humidity (32.5° C.–85%RH), and then the cartridge was loaded in the laser beam printer in the same environment and subjected to an image forming test of 10000 sheets. During the test, good images were obtained without occurrence of irregularities, such as pitch irregularities or fog. After the image forming test, the developing sleeve was taken out of the cartridge to examine whether any defects, such as play, loosening and dislocation, occurred at the joint between the gear and the cylinder, no defects in these respects were observed at all. The developing sleeve after the image forming test was fixed and subjected to measurement of a rupture torque at the joint by means of a commercially available torque gauge, whereby rupture was caused at a torque of 60 kg-cm.

The above-mentioned results of Examples and Comparative Examples are summarized in the following Table 1.

TABLE 1

| | Manner of fastening | Penetration | Cut length | Number of copied sheets, results | Rupture torque kg-cm |
|---|---|---|---|---|---|
| Example 1 | bending & cutting | 2.5 mm | 1.40 mm | 10000 sheets, no play or loosening | 160 |
| Example 2 | " | 2.0 mm | 1.10 mm | " | 145 |
| Example 3 | " | 1.5 mm | 0.85 mm | " | 122 |
| Example 4 | " | 1.0 mm | 0.55 mm | " | 70 |
| Comp. Example 1 | bonding | — | — | Gear dislocated at 500 sheets | 55 |
| Comp. Example 2 | staking | 0.5 mm | 0 mm | Play of 0.5 mm at 6000 sheets | 62 |
| Example 5 | bending & cutting | 1.5 mm | 0.85 mm | 10000 sheets, no play or loosening | 60 |

What is claimed is:

1. An image-bearing member for use in an electrophotographic image forming apparatus, said image-bearing member comprising:

a metallic cylinder having a wall thickness of 0.3–1.5 mm and having an electrophotographic photosensitive layer thereon; and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

2. An image-bearing member according to claim 1, wherein said electrophotographic photosensitive layer comprises a photoconductive layer.

3. An image-bearing member according to claim 2, wherein said cylinder comprises an aluminum tube and is cut in length of a least 0.2 mm at a bent and cut part thereof.

4. An image-bearing member according to claim 2, wherein said plural parts of said cylinder are not covered by said electrophotographic photosensitive layer.

5. An image-bearing member according to claim 1, wherein said cylinder is bent and cut at plural parts of an end brim thereof.

6. An image-bearing member according to claim 1, wherein said cylinder is bent and cut at a plurality of radially symmetrical parts thereof.

7. An image-bearing member according to claim 1, wherein said terminal engaging member comprises a flange.

8. An image-bearing member according to claim 1, wherein said terminal engaging member has a gear for receiving a drive force for rotating said image-bearing member.

9. A developing sleeve for use in an electrophotographic image forming apparatus, said developing sleeve comprising:

a metallic cylinder having a wall thickness of 0.3–1.5 mm and including a developer-carrying surface; and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

10. A developing sleeve according to claim 9, wherein said cylinder comprises an aluminum tube.

11. A developing sleeve according to claim 9, wherein said cylinder is cut in a length of a least 0.2 mm at a bent and cut part thereof.

12. A developing sleeve according to claim 9, wherein said cylinder is bent and cut at plural parts of an end brim thereof.

13. A developing sleeve according to claim 9, wherein said cylinder is bent and cut at a plurality of radially symmetrical parts thereof.

14. A developing sleeve according to claim 9, wherein said terminal engaging member comprises a gear.

15. A developing sleeve according to claim 9, wherein said terminal engaging member comprises a flange.

16. A processing unit detachably mountable to a main assembly of an image forming apparatus, said processing unit comprising:

an electrophotographic photosensitive member; and process means for acting on said electrophotographic photosensitive member, wherein said electrophotographic photosensitive member includes:

a metallic cylinder having a wall thickness of 0.3–1.5 mm and an electrophotographic photosensitive layer disposed thereon; and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

17. A processing unit according to claim 16, wherein said cylinder comprises an aluminum tube and is cut in a length of at least 0.2 mm at a bent and cut part thereof.

18. A processing unit according to claim 16, wherein said cylinder is bent and cut at plural parts of an end brim thereof.

19. A processing unit according to claim 16, wherein said cylinder is bent and cut at a plurality of radially symmetrical parts thereof.

20. A processing unit according to claim 16, wherein said terminal engaging member comprises a gear.

21. A processing unit according to claim 16, wherein said terminal engaging member comprises a flange.

22. A processing unit according to claim 16, wherein said process means comprises charging means.

23. A processing unit according to claim 16, wherein said process means comprises developing means.

24. An electrophotographic image forming apparatus, comprising:

an electrophotographic photosensitive member;

means for forming a latent image on said electrophotographic photosensitive member;

means for developing the latent image; and means for transferring the developed image onto a transfer-receiving member, wherein said electrophotographic photosensitive member comprises a metallic cylinder having a wall thickness of 0.3–1.5 mm and having an electrophotographic photosensitive layer thereon, and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts thereof project into said recesses and are intimately attached to said recesses so as to conform with said contours of said recesses, each of said plural parts thereby fixing a relative position between said cylinder and said terminal engaging member in both axial and rotational directions.

25. A processing unit, detachably mountable to a main assembly of an electrophotographic image forming apparatus, said processing unit comprising:

an electrophotographic photosensitive member; and developing means for developing a latent image formed on said electrophotographic photosensitive member, wherein said developing means includes:

a metallic cylinder having a wall thickness of 0.3–1.5 mm and having a developer-carrying surface; and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

26. A processing unit according to claim 25, wherein said cylinder comprises an aluminum tube and is cut in a length of a least 0.2 mm at a bent and cut part thereof.

27. A processing unit according to claim 25, wherein said cylinder is bent and cut at plural parts of an end brim thereof.

28. A processing unit according to claim 25, wherein said cylinder is bent and cut at a plurality of radially symmetrical parts thereof.

29. A processing unit according to claim 25, wherein said terminal engaging member comprises a gear.

30. A processing unit according to claim 25, wherein said terminal engaging member comprises a flange.

31. A processing unit according to claims 25, further comprising charging means.

32. An electrophotographic image forming apparatus, comprising:

an electrophotographic photosensitive member;

latent image-forming means for forming a latent image on said electrophotographic photosensitive member;

developing means for developing the latent image; and means for transferring the developed image onto a transfer-receiving member, wherein said developing means comprises a metallic cylinder having a wall thickness of 0.3–1.5 mm and having a developer-carrying surface, and a resinous terminal engaging member, including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

33. An electrophotographic photosensitive drum for use in an electrophotographic image forming apparatus, said photosensitive drum comprising:

a metallic cylinder having a wall thickness of 0.3–1.5 mm and having an electrophotographic photosensitive layer on a peripheral surface thereof; and a resinous terminal engaging member including a head which has a plurality of discrete recesses, each recess having a contour, positioned circumferentially around a periphery of said head, and a gear for receiving a drive force for rotating said electrophotographic photosensitive drum, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions, and said cylinder being provided with an end region not covered by said electrophotographic photosensitive layer on the peripheral surface thereof adjacent to said at least one open end to which said terminal engaging member is fastened.

34. A photosensitive drum according to claim 33, wherein said at least one open end of said cylinder is cut in a length of at least 0.4 mm.

35. A photosensitive drum according to claim 33, wherein said at least one open end of said cylinder is cut in a length of at least 0.4 mm.

36. A photosensitive drum according to claim 33, wherein said recesses are rectangular, circular, arced or triangular.

37. A photosensitive drum according to claim 36, wherein said recesses have a width of at least 1.0 mm and a height of at least 0.5 mm.

38. A photosensitive drum according to claim 33, wherein said cylinder comprises aluminum, copper, or stainless steel.

39. A photosensitive drum according to claim 34, wherein said end region has a length of at least 1.0 mm in a longitudinal direction of said cylinder.

40. A photosensitive drum according to claim 33, wherein said electrophotographic photosensitive layer comprises a photoconductive layer.

41. A photosensitive drum according to claim 40, wherein said cylinder comprises aluminium and the photoconductive layer is disposed on the peripheral surface of said cylinder.

42. A processing unit detachably mountable to a main assembly of an electrophotographic image forming apparatus, said processing unit comprising:

an electrophotographic photosensitive drum; and process means for acting on said electrophotographic photosensitive drum, wherein said electrophotographic photosensitive drum includes:

a metallic cylinder having a wall thickness of 0.3–1.5 mm and having an electrophotographic photosensitive layer on a peripheral surface thereof; and a resinous terminal engaging member including a head which has a plurality of discrete recesses, each recess having a contour, positioned circumferentially around a periphery of said head, and a gear for receiving a drive force for rotating said electrophotographic photosensitive drum, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions, and said cylinder being provided with an end region not covered by the electrophotographic photosensitive layer on the peripheral surface thereof adjacent to said at least one open end to which said terminal engaging member is fastened.

43. A processing unit according to claim 42, wherein said process means comprises cleaning means for removing residual toner on a peripheral surface of said electrophotographic photosensitive drum.

44. A processing unit according to claim 42, wherein said process means comprises charging means for charging said electrophotographic photosensitive drum.

45. A processing unit according to claim 42, wherein said process means comprises developing means for developing a latent image formed on said electrophotographic photosensitive drum.

46. An electrophotographic image forming apparatus for forming an image on a recording medium, said image forming apparatus comprising:

mounting means for detachably mounting a processing unit thereto; and conveying means for conveying the recording medium, wherein said processing unit includes:

an electrophotographic photosensitive drum; and process means for acting on said electrophotographic photosensitive drum, wherein said electrophotographic photosensitive drum includes:

a metallic cylinder having a wall thickness of 0.3–1.5 mm and having an electrophotographic photosensitive layer on a peripheral surface thereof; and a resinous terminal engaging member including a head which has a plurality of discrete recesses, each recess having a contour, positioned circumferentially around a periphery of said head, and a gear for receiving a drive force for rotating said electrophotographic photosensitive drum, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions, and said cylinder being provided with an end region not covered by said electrophotographic photosensitive layer on the peripheral surface thereof adjacent to said at least one open end to which said terminal engaging member is fastened.

47. An electrophotographic image forming apparatus for forming an image on a recording medium, said image forming apparatus comprising:

an electrophotographic photosensitive drum;

means for forming a latent image on said photosensitive drum;

developing means for developing the latent image formed on said photosensitive drum to form a developed image on said photosensitive drum; and transfer means for transferring the developed image formed on said photosensitive drum to the recording medium, wherein said electrophotographic photosensitive drum includes:

a metallic cylinder having a wall thickness of 0.3–1.5 mm and having an electrophotographic photosensitive layer on a peripheral surface thereof; and a resinous terminal engaging member including a head which has a plurality of discrete recesses, each recess having a contour, positioned circumferentially around a periphery of said head, and a gear for receiving a drive force for rotating said electrophotographic photosensitive drum, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions, and said cylinder being provided with an end region not covered by said electrophotographic photosensitive layer on the peripheral surface thereof adjacent to said at least one open end to which said terminal engaging member is fastened.

48. A developing sleeve for use in an electrophotographic image forming apparatus, said developing sleeve comprising:

a metallic cylinder having a wall thickness of 0.3–1.5 mm; and p1 a resinous terminal engaging member including a head which has a plurality of discrete recesses, each recess having a contour, positioned circumferentially around a periphery of said head, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

49. A developing sleeve according to claim 48, wherein said at least one open end of said cylinder is cut in a length of at least 0.2 mm.

50. A developing sleeve according to claim 48, wherein said recesses are rectangular, circular, arced or triangular.

51. A developing sleeve according to claim 50, wherein said recesses have a width of at least 1.0 mm and a height of at least 0.5 mm.

52. A developing sleeve according to claim 48, wherein said cylinder comprises aluminum, copper or stainless steel.

53. A processing unit detachably mountable to a main assembly of an electrophotographic image forming apparatus, said processing unit comprising:

an electrophotographic photosensitive drum;

developing means for developing a latent image formed on said electrophotographic photosensitive drum, wherein said developing means includes a developing sleeve including:

a metallic cylinder having a wall thickness of 0.3–1.5 mm, and a resinous terminal engaging member including a head which has a plurality of discrete recesses, each recess having a contour, positioned circumferentially around a periphery of said head; and a gear for receiving a drive force for rotating said developing sleeve, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

54. A processing unit according to claim 53, further comprising cleaning means for removing residual toner on a peripheral surface of said electrophotographic photosensitive drum.

55. A processing unit according to claim 53, further comprising charging means for charging said electrophotographic photosensitive drum.

56. An electrophotographic image forming apparatus for forming an image on a recording medium, said image forming apparatus comprising:

mounting means for detachably mounting a processing unit thereto; and conveying means for conveying the recording medium, wherein said processing unit includes:

an electrophotographic photosensitive drum; and developing means for developing a latent image formed on said electrophotographic photosensitive drum, wherein said developing means includes a developing sleeve including:

a metallic cylinder having a wall thickness of 0.3–1.5 mm, and a resinous terminal engaging member including a head which has a plurality of discrete recesses, each recess having a contour, positioned circumferentially around a periphery of said head; and a gear for receiving a drive force for rotating said developing sleeve, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

57. An electrophotographic image forming apparatus for forming an image on a recording medium, said image forming apparatus comprising:

an electrophotographic photosensitive drum;

means for forming a latent image on said electrophotographic photosensitive drum;

developing means for developing the latent image formed on said electrophotographic photosensitive drum to form a developed image on said electrophotographic photosensitive drum; and transfer means for transferring the developed image formed on said electrophotographic photosensitive drum to the recording medium, wherein said developing means includes:

a developing sleeve comprising a metallic cylinder having a wall thickness of 0.3–1.5 mm, and a resinous terminal engaging member including a head which has a plurality of discrete recesses, each recess having a contour, positioned circumferentially around a periphery of said head; and a gear for receiving a drive force for rotating said developing sleeve, said terminal engaging member being inserted into, and being fastened to, at least one open end of said cylinder by bending and cutting said at least one open end of said cylinder, at discontinuous plural parts thereof, such that said plural parts project into said recesses and are intimately attached to said recesses so as to conform with said contours of said recesses, each of said plural parts thereby fixing a relative position between said cylinder and said terminal engaging member in both axial and rotational directions.

* * * * *

UNITED STATES PATENT AND TRADEMARK OFFICE

CERTIFICATE OF CORRECTION

PATENT NO. : 5,771,425

DATED : June 23, 1998

INVENTOR(S) : YUSUKE YAMADA, ET AL.

It is certified that error appears in the above-identified patent and that said Letters Patent is hereby corrected as shown below:

ABSTRACT [57]

Line 6, "assocrated" should be deleted.

COLUMN 7

Line 16, "after the image transfer" should be deleted.

COLUMN 9

Line 40, "after the" should read --after--.

COLUMN 11

Line 40, "length" should read --a length--, and "a least" should read --at least--.

COLUMN 12

Line 24, "a least" should read --at least--.

COLUMN 13

Line 60, " a least" should read --at least--.

UNITED STATES PATENT AND TRADEMARK OFFICE

CERTIFICATE OF CORRECTION

PATENT NO. : 5,771,425

DATED : June 23, 1998

INVENTOR(S) : YUSUKE YAMADA, ET AL.

It is certified that error appears in the above-identified patent and that said Letters Patent is hereby corrected as shown below:

COLUMN 14

Line 40, "drum, said" should read --drum, ¶ said-- (insert paragraph).
Line 57, "0.4" should read --0.2--.

COLUMN 15

Line 1, "34," should read --33,--.

COLUMN 16

Line 64, "and p1 a" should read --and ¶ a-- (insert paragraph).

Signed and Sealed this

Second Day of March, 1999

*Attest:*

Q. TODD DICKINSON

*Attesting Officer*

*Acting Commissioner of Patents and Trademarks*